US005887865A

United States Patent [19]

Ishimaru

[11] Patent Number: 5,887,865

[45] Date of Patent: Mar. 30, 1999

[54] DOCUMENT FEEDER FOR IMAGE-FORMING APPARATUS AND IMAGE-FORMING APPARATUS, USING THE SAME

[75] Inventor: Shuji Ishimaru, Yamanashi, Japan

[73] Assignees: Konica Corporation; Nisca Corporation, both of Japan

[21] Appl. No.: 868,620

[22] Filed: Jun. 3, 1997

[30] Foreign Application Priority Data

Jun. 10, 1996 [JP] Japan ..... 8-171705

[51] Int. Cl.[6] ..... B65H 5/22

[52] U.S. Cl. ..... 271/4.7; 271/3.21; 271/3.19; 271/291; 271/186; 399/374; 399/373; 399/380

[58] Field of Search ..... 271/9.09, 4.1, 271/3.19, 3.21, 291, 305, 186; 399/373, 374, 379, 380, 364

[56] References Cited

U.S. PATENT DOCUMENTS

| | | | |
|---|---|---|---|
| 4,714,241 | 12/1987 | Randall | 271/186 |
| 5,054,768 | 10/1991 | Iseda | 271/291 |
| 5,534,989 | 7/1996 | Rubscha et al. | 271/186 |
| 5,596,399 | 1/1997 | Dempsey et al. | 399/374 |
| 5,689,793 | 11/1997 | Kobayashi et al. | 399/374 |
| 5,784,680 | 7/1998 | Taruki | 399/374 |

FOREIGN PATENT DOCUMENTS 175279 7/1995 Japan .

133551 5/1996 Japan .

*Primary Examiner*—H. Grant Skaggs

*Attorney, Agent, or Firm*—Jordan B. Bierman; Bierman, Muserlian and Lucas

[57] ABSTRACT

According to a document feeder for an image-forming apparatus of the present invention, when a double-sided document fed from a feed paper stacker, the document with the front surface thereof having been read out by a document reader unit is inverted in a switch-back path provided between the document reader unit and a discharged paper stacker on which documents after having been read out will be stacked, and is conveyed again to the paper reader unit so that the back surface is read out. The document after its both surfaces have been read out is again inverted in the switch-back path and then discharged onto the discharged paper stacker. With such a construction, the documents after having been read out can be stacked in the order of sequence of pages of the documents. Furthermore, the size of the device can be decreased, contributing to shortening the time required for reading the double-sided document and to increasing the efficiency for forming images. Accordingly, disadvantages, such as the damage to the document, contamination of the document reader unit or the jam of the document in a halfway of conveyance, can be suppressed or prevented. Moreover, the document conveyed to the switch-back path from the feeder section does not hinder the document discharged onto the discharge stacker from the switch-back path, making it possible to convey the document smoothly and efficiently.

22 Claims, 5 Drawing Sheets

DOCUMENT FEEDER FOR IMAGE-FORMING APPARATUS AND IMAGE-FORMING APPARATUS, USING THE SAME

BACKGROUND OF THE INVENTION

1. Field of the Invention

The present invention relates to a document feeder for automatically feeding documents to a document reader unit of an image-forming apparatus such as electrophotographic copying machine or the like machine, and an image-forming apparatus using the document feeder. More specifically, the invention relates to a document feeder for reading double-sided documents, and an image-forming apparatus using the document feeder.

2. Background Art

As is well known, an image-forming apparatus such as electrophotographic copying machine or the like machine is employing a so-called ADF (automatic document feeder) for automatically feeding documents to a document reader unit. In recent years, it has been desired to develop a document feeder capable of handling double-sided documents having images formed on both surfaces thereof.

There has been proposed a document feeder capable of handling double-sided documents having images formed on both surfaces as exemplified by, for example, a document processing machine disclosed in Japanese Unexamined Patent Publication No. 7-175279. This document processing machine has two modes. In a first mode, a single-sided document is read out and is directly discharged onto a discharge tray. In a second mode, a first surface of a double-sided document is read out and the document is once fed onto a discharge tray and, then, the document is not completely discharged but is switched back on the discharge tray and is fed again onto a document feed passage through a double-side feed passage. A second surface is then read out and the document is fed onto the discharge tray. The document is not completely discharged onto the discharge tray but is switched back again, fed again onto the document feed passage through the double side feed passage and is then discharged and stacked on the discharge tray with the first surface being faced downwards, so that pages are in order when the double-sided documents are successively stacked on the discharge tray. Therefore, the double-sided document is circulated by a roller that effects the discharge and inversion at the inlet of the discharge tray and by the double-side feed passage which feeds the document from the discharge tray onto the document feed passage. To discharge t he double-sided document, the document is inverted by the roller, and is discharged onto the discharge tray by the above-mentioned roller through a passage similar to that for reading the second surface of the document.

There has further been proposed a sheet conveyer device as disclosed in, for example, Japanese Unexamined Patent Publication No. 8-133551 (Japanese Patent Application No. 6-298816). According to this technology, after the second surface is read out, the double-sided document is inverted (switched back) by an inversion unit provided on a place deviated from the discharge tray and is discharged onto the discharge tray so as to be stacked with the first surface being faced downwards, so that pages are in order when the double-sided documents are successively stacked on the discharge tray. This technology is the same as the one disclosed in the above-mentioned Japanese Unexamined Patent Publication No. 7-175279 in regard to that the double-sided document is inverted on the discharge tray in order to read the second surface.

In reading the double-sided document according to the technology of the above-mentioned Japanese Unexamined Patent Publication No. 7-175279, however, the document must be passed through the document reader unit three times when it is attempted to stack the documents on the discharge tray so that the pages are in order. In the third time of passage, however, the document simply passes through the document reader unit without being read out, but to cause the document reader unit to be fouled which then causes the image that is read out to become defective and makes it necessary to clean the document reader unit frequently. After the document is read out, the document reader unit is ready to read a next document. In order to sequentially discharge the documents, however, the documents must be passed through the document reader unit though they need not be really read out. Even after the document is read out, therefore, it is not allowed to feed the next document, making it difficult to increase the speed for reading the document. Moreover, the document must be conveyed over an increased distance requiring an extended period of time for conveying the document; i.e., efficiency for forming image decreases, and the document is likely to be damaged due to the pressure and friction created during the conveyance. Moreover, the document is inverted on the discharge tray. Therefore, the user may erroneously regard the document discharged on the discharge tray for being inverted to be the document that is discharged after the completion of the processing and may take it out. In such a case, the document processing machine comes into a halt due to defective conveyance of the paper. Furthermore, the image-forming machine that is forming images on both surfaces is also brought into a halt in the middle of image forming; i.e., the whole machine is halted.

According to the technology disclosed in Japanese Unexamined Patent Publication No. 8-133551, the double-sided document is inverted on the discharge tray like that of the above-mentioned Japanese Unexamined Patent Publication No. 7-175279 giving rise to the occurrence of a problem in that the document processing machine is halted due to defective conveyance of the paper and the whole image-forming apparatus is brought into a halt. Moreover, a plurality of inversion processing units are necessary requiring drive transmission mechanisms for the plurality of inversion rollers and control mechanisms therefor. Accordingly, the apparatus becomes complex and bulky necessitating a complex control mechanism.

SUMMARY OF THE INVENTION

In view of the above-mentioned problems of the conventional document feeders for handling the double-sided documents, the object of the present invention is to provide a document feeder for an image-forming apparatus, which as a whole is simply constructed in a small size and is capable of efficiently handling the double-sided documents.

In order to accomplish the above-mentioned object, the document feeder for an image-forming apparatus according to the present invention comprises:

- a document feeder for an image-forming apparatus comprising:
  - a feed paper stacker on which double-sided documents will be stacked;
  - a discharged paper stacker on which said documents after having been read out will be stacked;
  - a circulating path for guiding the documents through a document-reading position;
  - a feed path for feeding the documents from said feed paper stacker to said circulating path;

a discharge path for discharging the documents after having been read out onto the discharged paper stacker;

a switch-back path for switching back the document, disposed under said feed path or the feed paper stacker;

a first conveying direction switching means provided at a portion where the circulating path and the switch-back path are connected together to change over the direction of conveyance of the document to either the circulating path or the switch-back path; and a second conveying direction switching means provided at a portion where the circulating path and the discharge path are connected together to change over the direction of conveyance of the document to either the circulating path or the discharge path.

Furthermore, the image-forming apparatus of the present invention comprises:

an image-forming apparatus comprising:

a document reader means for reading images of documents;

a feed paper stacker on which double-sided documents will be stacked;

a discharged paper stacker on which said documents after having been read out will be stacked;

a circulating path for guiding the documents through said document reader means;

a feed path for feeding the documents from said feed paper stacker to said circulating path;

a discharge path for discharging the documents after having been read out onto the discharged paper stacker;

a switch-back path for switching back the document, disposed under said feed path or said feed paper stacker;

a first conveying direction switching means provided at a portion where the circulating path and the switch-back path are connected together to change over the direction of conveyance of the document to either the circulating path or the switch-back path; and a second conveying direction switching means provided at a portion where the circulating path and the discharge path are connected together to change over the direction of conveyance of the document to either the circulating path or the discharge path.

With such a construction, the document after its both surfaces are read out is inverted on the downstream side of the document reader unit but on the upstream side of the discharge path, and is discharged onto the discharged paper tray. Unlike that of the prior art, therefore, the document is not circulated when it is not to be read out, making it possible to shorten the distance of conveyance and to convey the next document to the document reader unit maintaining a short time interval to read it, contributing to shortening the time required for reading both sides of the document and to increasing the efficiency for forming images. Besides, the document needs be passed through the document reader unit two times instead of three times, causing the document to be less damaged and the document reader unit to be less contaminated. Accordingly, no defect occurs in the image that is read out, and the cleaning operation needs not be executed so frequently. Moreover, the document is inverted in a specially provided switch-back path and in space and not on the discharged paper tray; i.e., the document is not discharged onto the discharge tray for being inverted. Therefore, it does not happen that the user takes out the document that is being inverted by erroneously regarding it to be a document that is discharged after the completion of the processing. Accordingly, the document feeder is not brought into a halt that stems from the defective feeding of the paper or the image-forming apparatus is not brought into a halt while images are being formed on both surfaces, making it possible to avoid a trouble in that the apparatus as a whole is brought into a halt.

With the feed paper stacker, discharged paper stacker and switch-back path being arranged on the same side relative to the reading position, furthermore, the projecting area of the document feeder can be decreased making it possible to decrease the size of the device.

With the feed paper stacker, discharged paper stacker and switch-back path being arranged in this order from the upper side like layers, furthermore, the document flowing from the feed paper stacker down to the switch-back path does not intersect the document flowing from the switch-back path down to the discharged paper stacker. Therefore, the document flows smoothly and images on both surfaces of the document are efficiently read out.

If the switch-back path is formed in space under the discharged paper stacker, space inside the document feeder is effectively utilized, making it possible to realize the device in a further decreased size.

By providing the switch-back path with a reversible roller which can be turned forward and reverse, furthermore, the document can be switched back stably and reliably.

Furthermore, provision of the reversible rollers constituted by a pair of rollers in a manner of being allowed to be separated from each other, makes it possible to avoid the occurrence of jamming even when the front end of the document that is sent from the switch-back path to the circulating path to read its back surface, has arrived at the position of the pair of reversible rollers before its rear end has not yet passed through the pair of the reversible rollers. Therefore, there is no need to unnecessarily lengthen the circulating path; i.e., a compactly constructed device exhibits a highly reliable feeding performance.

Moreover, the discharge path needs be provided with a discharge roller that can be rotated in one direction only, making it possible to simplify the mechanism of the device and its control operation.

With the circulating path being formed along the outer peripheral surface of the feed roller, furthermore, the front end and the rear end of the double-sided document can be efficiently guided along the same outer peripheral surface, offering such advantages that the structure is simple and trouble such as jamming does not occur.

Other objects and features of the present invention will become obvious from the following description of the embodiment in connection with the accompanying drawings.

DESCRIPTION OF THE PREFERRED EMBODIMENT

Figure 1:
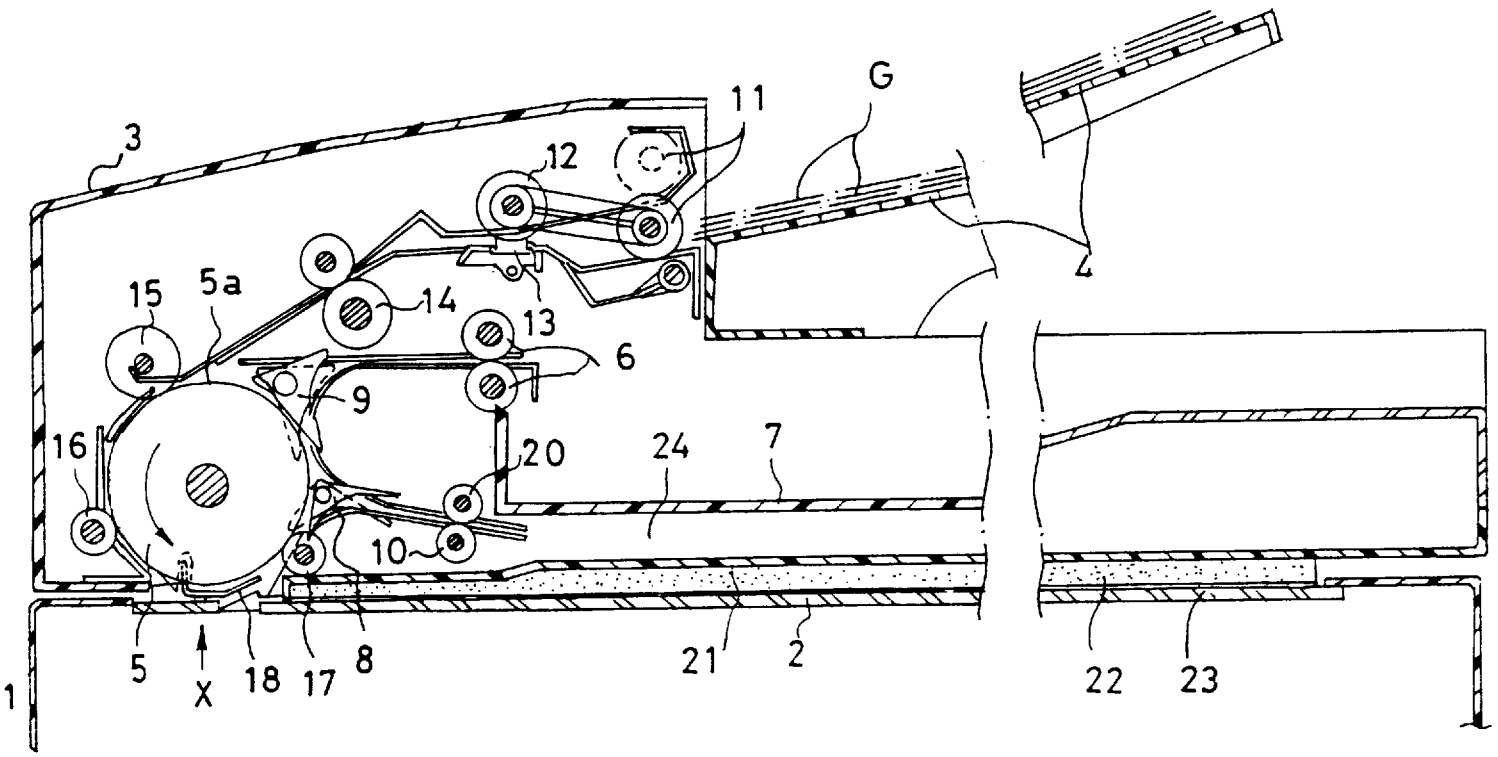
FIG. 1 is a sectional view illustrating a whole document feeder according to the present invention but omitting a portion thereof.

The invention will now be described in detail with reference to the drawings.

The diagramed embodiment is an example applied to an electrophotographic copying machine which is one of image-forming apparatus. On an upper part of the body 1 of the electrophotographic copying machine is arranged a glass for placing document, i.e., a platen 2, and at one side of the platen 2 is provided a document reader unit X constituted by CCD elements that are not shown in the figure.

A housing 3 of a document feeder of the present invention is positioned over the platen 2, the housing 3 being provided with a feed paper stacker 4 positioned over the platen 2. It is allowed to stack a plurality of pieces of documents G on the feed paper stacker 4.

A circulating path a is formed on the outer peripheral surface 5*a* of a feed roller 5 of a large diameter facing the document reader unit X. The circulating path a is constituted by a first conveyer passage a1 for conveying a document from a portion where it is connected to a feed path b to a portion where it is connected to a discharge path c, and a second conveyer passage a2 for circulating a double-sided document from a portion where it is connected to the discharge path c to a portion where it is connected to the feed path b. In the case of single-sided documents G, these documents G are fed piece by piece from the feed paper stacker 4 through the feed path b onto the first conveyer passage a1 of the circulating path. After read out by the document reader unit X provided along the first conveyer passage a1, the document G is discharged and stacked on a discharged paper stacker 7 positioned substantially under the feed paper stacker 4 passing through the discharge path c which is provided with discharge rollers 6.

In the case of the double-sided documents G, the double-sided document G with the front surface thereof having been read out in the same manner as that of the single-sided document is conveyed to a switch-back path d provided under the discharge path c, switched back by the switch-back path d, conveyed again onto the circulating path a, conveyed to the first conveyer passage a1 through the second conveyer passage a2, and is subjected to a processing for reading the image on the back surface by the document reader unit X.

In order to execute the processing for reading image, a first conveying direction switching means 8 is provided at a portion where the first conveyer passage a1 of the circulating path a and the switch-back path d are connected together, to change over the direction of conveying the document to either the switch-back path or the circulating path. Furthermore, a second conveying direction switching means 9 is provided at a portion where the second conveyer passage a2 of the circulating path a and the discharge path c are connected together, to change over the direction of conveying the document to either the discharge path or the circulating path. That is, when the first conveying direction switching means 8 is at a switched position indicated by a solid line in FIG. 1, the document G is conveyed along the first conveyer passage a1 of the circulating path a. When the first conveying direction switching means 8 is at a position indicated by a two-dot chain line, the document G conveyed along the first conveyer passage a1 of the circulating path a is guided toward a reversible roller 10 provided in the switch-back path d in order to switch back the document within space 24 provided for the switch-back path d.

The second conveying direction switching means 9 that is at a switched position indicted by a solid line, closes the inlet of the discharge path c, directs the document G conveyed from the switch-back path d along the circulating path a toward the second conveyer passage a2 of the circulating path a, so that the document G circulates through the second conveyer passage a2 along the outer peripheral surface 5*a* of the feed roller 5. When switched to a position indicated by a two-dot chain line, the second conveying direction switching means 9 directs the single-sided document G conveyed along the first conveyer passage a1 of the circulating path or the double-sided document G conveyed from the switch-back path d along the circulating path a and of which both surfaces have been read out, toward the discharge path c, so that it is discharged onto the discharged paper stacker.

The feed path b, circulating path a constituted by the first conveyer passage a1 and the second conveyer passage a2, switch-back path d, and a mechanical part of the discharge path c will now be described in detail with reference to FIG. 2. At the inlet of the feed path b is disposed a delivery mechanism constituted by kick rollers 11, a feed roller 12 and a separating member 13. Upon operating the delivery mechanism, the documents G stacked on the feed paper stacker 4 are delivered piece by piece onto the feed path b starting from the uppermost piece with the surface of the document being faced upwards.

On the feed path b are disposed a first resist roller 14 and a second resist roller 15 that are neighboring each other in the direction for feeding the document G. Owing to the rotational motion of the first resist roller 14 and the second resist roller 15, the document G is fed toward the first conveyer passage a1 of the circulating path a. The feed roller 12 and the first resist roller 14 are driven to rotate in one direction only by a drive motor M1 through one-way clutches OW that transmit the rotational force in one direction only.

The feed roller 5 of the circulating path a is driven to rotate in the direction of arrow. Two contact rollers 16 and 17 rotate in contact with the outer peripheral surface 5*a* of the feed roller 5, so that the document G is fed toward the document reader unit X being intimately contacted onto the outer peripheral surface 5*a* of the roller 5. In the document reader unit X, the surface of the document G is brought into intimate contact with the surface of the platen 2 due to a pushing member 18.

Figure 3:
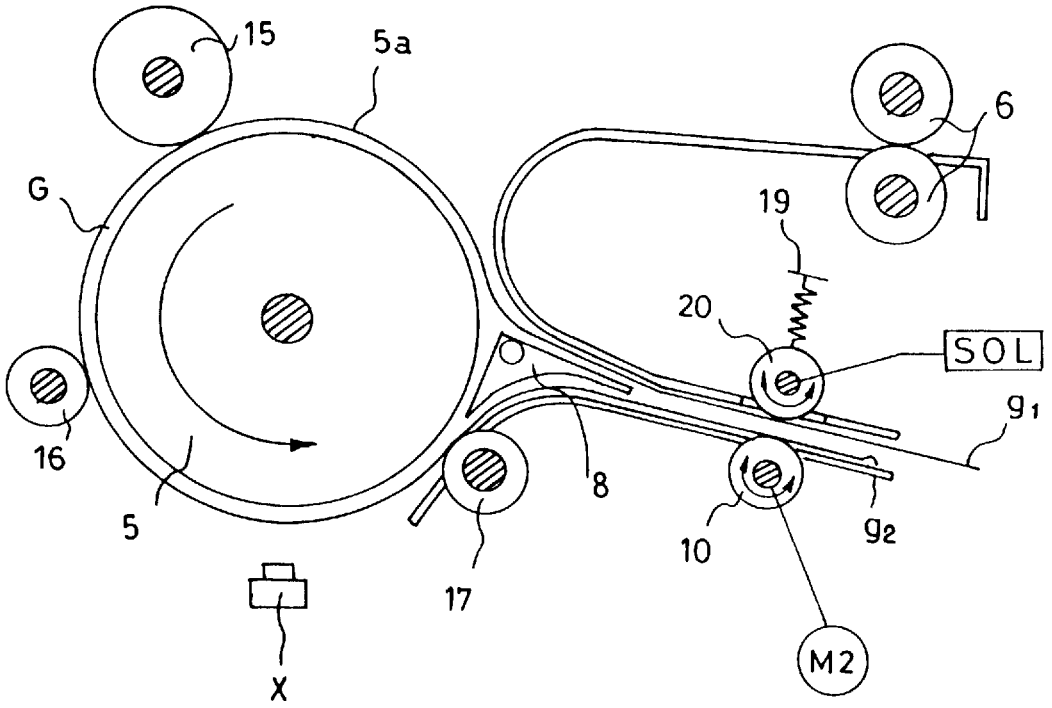
FIG. 3 is a view illustrating, on an enlarged scale, a switch-back roller in the document feeder.

Referring to FIG. 3, a reversible roller 10 that can rotate forward and reverse is disposed in the switch-back path d. A follower roller 20 rotates being pushed onto the peripheral surface of the reversible roller 10 by a pushing spring 19. By exciting an electromagnetic solenoid SOL, the follower roller 20 is separated from the reversible roller 10, and the timing for conveying the double-sided document to the switch-back path d is controlled by the forward turn or the reverse turn of the reversible roller 10.

Figure 2:
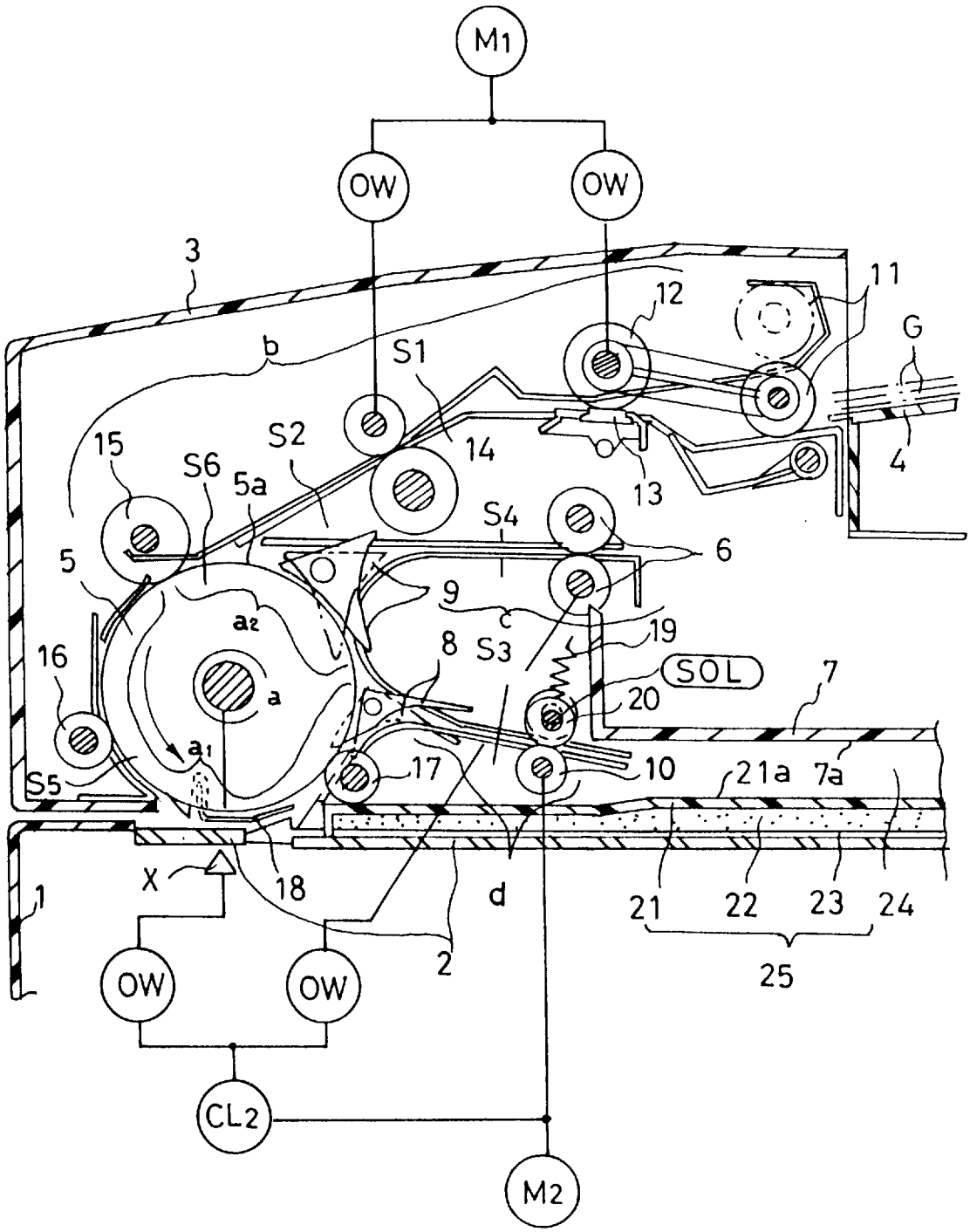
FIG. 2 is a sectional view illustrating, on an enlarged scale, a portion of the document feeder.

The reversible roller 10 is driven by a reversible motor M2 shown in FIG. 2. The reversible motor M2 further drives the feed roller 5 and the discharge roller 6 through a clutch CL2 that controls the timing for transmitting the driving power and through one-way clutches OW for transmitting the rotational force in one direction only.

Document sensors S1 to S6 shown in FIG. 2 are disposed for the feed path b, circulating path a constituted by the first conveyer passage a1 and the second conveyer passage a2, switch-back path d and discharge path c. The front end and the rear end of the document G are detected by these document sensors S1 to S6.

The document placed by hand on the surface of the platen 2 is intimately contacted to the surface of the platen 2 due to a pushing plate 25. Here, in order to constitute the pushing plate 25, a thick and elastically deformable porous layer 22 is laminated on the lower surface of a hard plastic support plate 21 which constitutes the bottom surface of the housing 3 of the document feeder, and the porous layer 22 is covered with a soft surface layer 23. Therefore, the front end g1 of the double-sided document conveyed onto the switch-back path d is disposed on the same side relative to the circulating path a under the feed paper stacker 4 and the feed path b. More concretely speaking, the document is introduced into space 24 defined by the discharged paper stacker 7 and the support plate 21, and is guided by a bottom surface 7*a* of the discharged paper stacker 7 having a small coefficient of friction and by an upper surface 21*a* of the support plate 21. Accordingly, the document can be switched back without being folded.

Figure 4A:
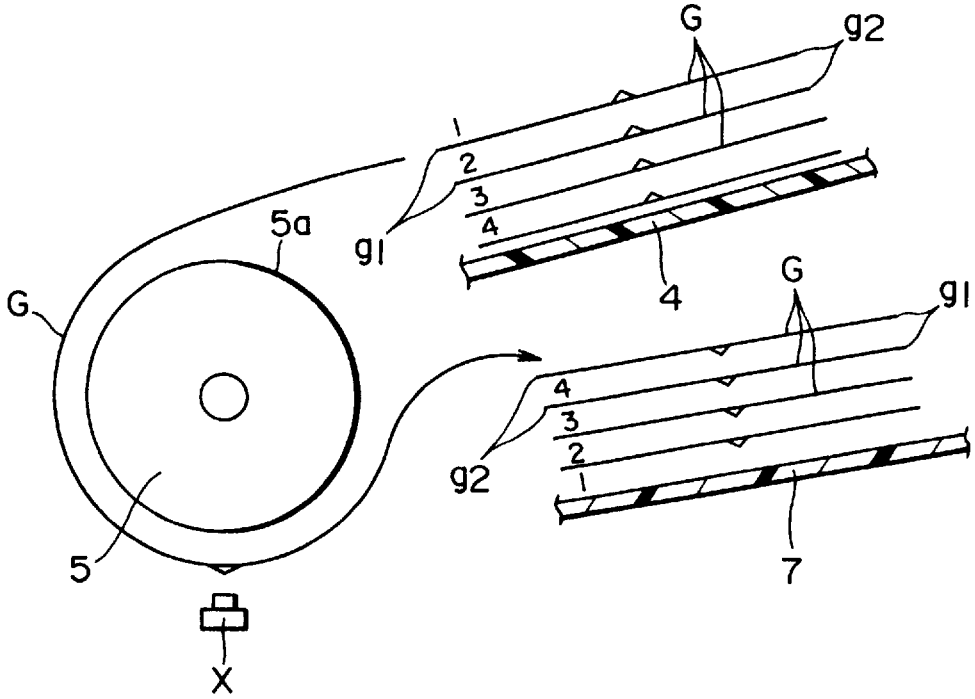
FIGS. 4(*a*) and 4(*b*) are diagrams schematically illustrating states for trapping a document.
Figure 4B:
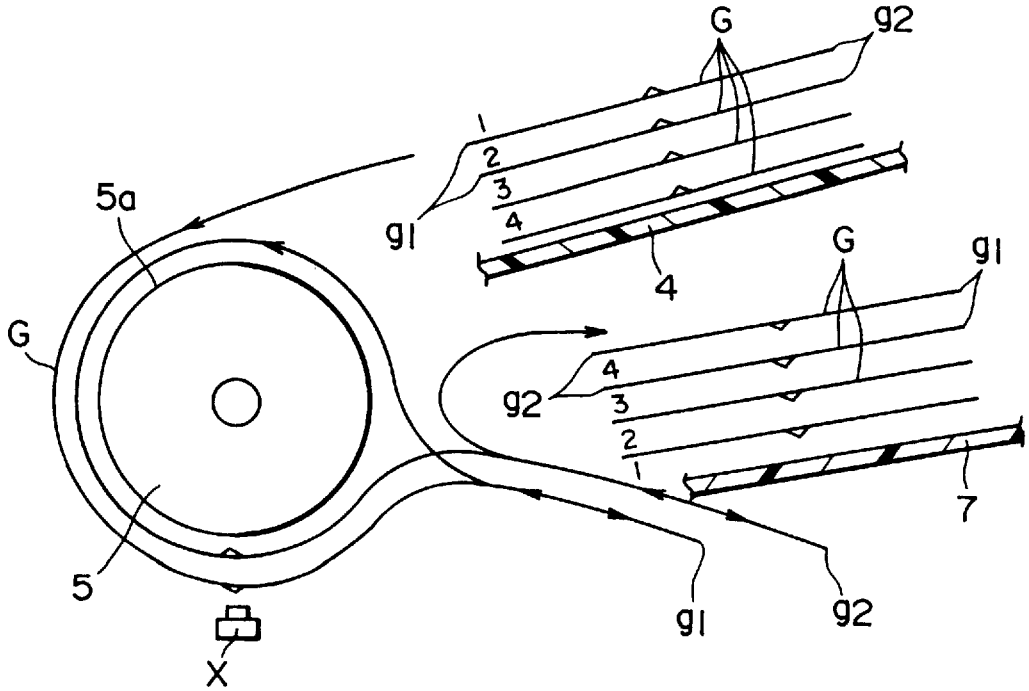

The document feeder for the image-forming apparatus according to the embodiment is constituted as described above. Therefore, when the document G fed from the feed paper stacker 4 is a single-sided document, the document is discharged as shown in FIG. 4(*a*) onto the discharged paper stacker 7 through the switch-back path d and the discharge path c. In the case of the double-sided document, the document is discharged onto the discharged paper stacker 7 in a state as shown in FIG. 4(*b*).

First, in the case of reading the single-sided documents that are stacked on the feed paper stacker 4 with its surface being faced upwards, the surface of the document is turned downwards while being conveyed through the first conveyer passage a1 of the circulating path a. Therefore, the document is directly discharged onto the discharged paper stacker 7 from the first conveyer passage a1 through the discharge path c. That is, in the case of reading the documents G having images formed on the front surfaces only and having sequence of pages, the documents after read are successively stacked on the discharged paper stacker 7 with the surface of the documents being faced downwards. When the documents G that have been read are taken out from the discharged paper stacker 7, therefore, there is no need to rearrange the sequence of pages of the documents.

In the case of reading the double-sided documents G, the double-sided documents are stacked on the feed paper stacker 4 with their surfaces being faced upwards like the single-sided documents. The document G after its both surfaces have been read is once conveyed onto the switch-back path d from its front end g1 as shown in FIG. 4(*b*), switched back within space 24 provided for the switch-back path d, and is circulated from its rear end g2 into the second conveyer passage a2 of the circulating path a, so that the back surface thereof is read by the document reader unit X.

Thereafter, the double-sided document G is conveyed again from its rear end g2 onto the switch-back path d, switched back within space 24 provided for the switch-back path d, conveyed from its front end g1 onto the first conveyer passage a1, and is discharged through the discharge path. Therefore, the double-sided documents that have been read are successively stacked on the discharged paper stacker 7 with their surfaces being faced downwards. When the double-sided documents that have been read are taken out from the discharged paper stacker 7, therefore, there is no need to rearrange the sequence of pages of the documents.

Figure 5:
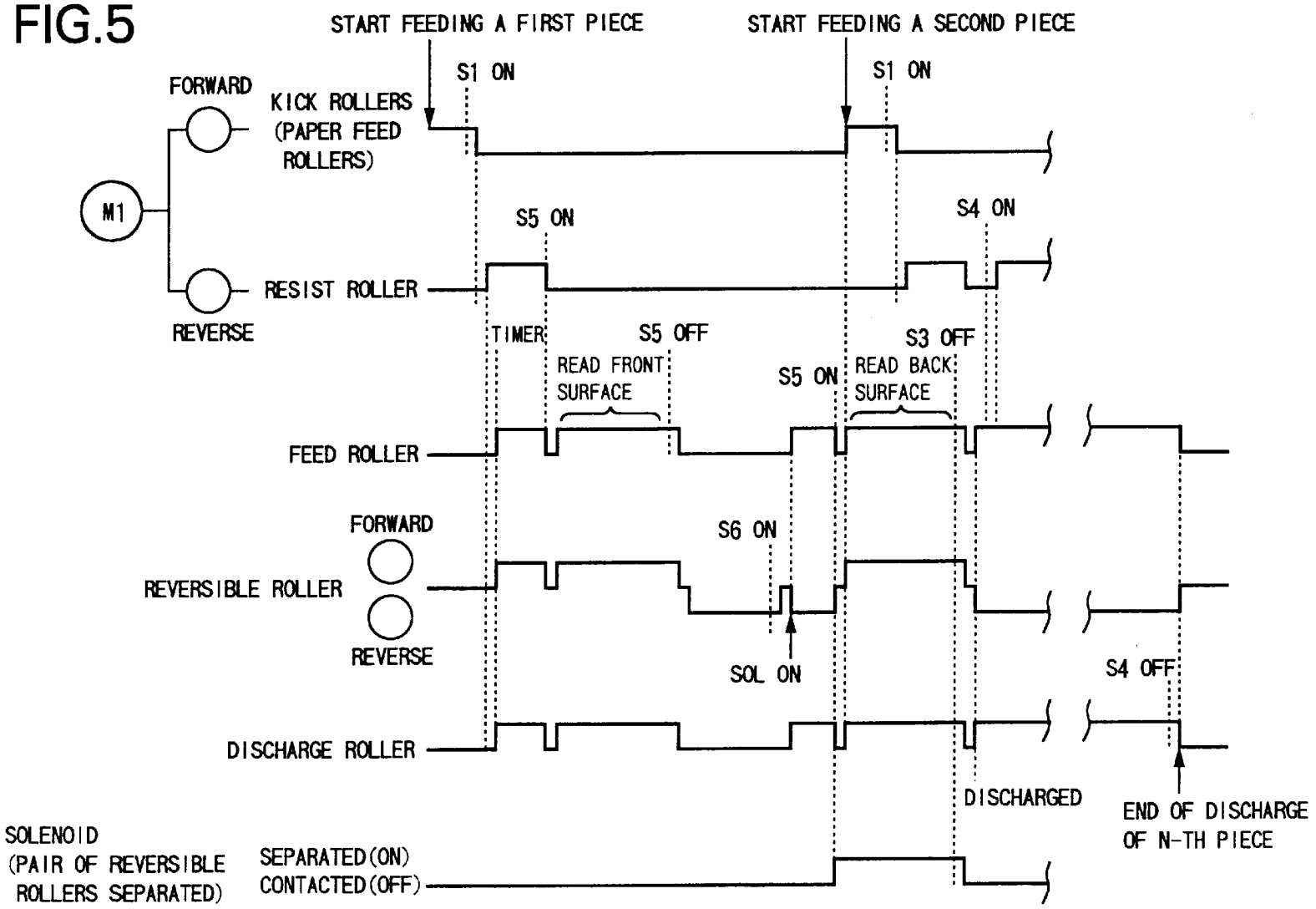
FIG. 5 is a diagram of time sequence of the document feeder.

The processing for reading the double-sided documents will now be described in detail with reference to a time sequence of FIG. 5. When a double-side processing mode is selected by an operator, the first conveying direction switching means 8 is changed over to the position indicated by the two-dot chain line and the second conveying direction switching means 9 is changed over to the position indicated by the solid line.

Thereafter, the documents G placed on the feed paper stacker 4 are fed piece by piece onto the feed path b by the kick rollers 11 and the feed roller. Here, when the front end g1 of the document G is detected by the document sensor S1, the kick rollers 11 and the feed roller cease to rotate after the elapse of a predetermined period of time, and the first resist roller 14 starts rotating so that the document G is conveyed toward the first conveyer passage a1 of the circulating path a. Then, after a predetermined period of time set by a timer has passed, the feed. roller 5, reversible roller 10 and discharge roller 6 start rotating to promote discharging the documents remaining in the circulating path, switch-back path d and discharge path c. At a moment when the front end g1 of the document G is detected by the document sensor S5, the feed roller 5, reversible roller 10 and discharge roller 6 temporarily stop rotating. Upon driving these rollers again, the surface of the document G is read by the document reader unit X while being conveyed in the sub-scanning direction.

When the surface of the document G is read out and the rear end g2 of the document G is detected by the document sensor S5, the feed roller 5, reversible roller 10 and discharge roller 6 stop rotating after the elapse of a predetermined period of time from the above detection, and the rear end g2 of the document G is detected by the document sensor S3. Next, the reversible roller 10 is reversibly driven by a signal from the document sensor S3, and the document G is switched back from its rear end g2 toward the second conveyer passage a2 of the circulating path. In this case, the rear end g2 of the document G is conveyed onto the second conveyer passage a2 of the circulating path a being guided by the outer peripheral surface 5*a* of the feed roller 5 that is at rest and by the second conveying direction switching means 9. When the rear end g2 of the document G is detected by the document sensor S6 in front of the second resist roller, the reversible roller 10 ceases to rotate and, at the same time, the electromagnetic solenoid SOL is excited so that the follower roller 20 is forcibly separated away from the reversible roller 10. Accordingly, the driving force of the reversible roller 10 is no longer transmitted to the document G.

Upon detection by the document sensor S6, furthermore, the feed roller 5 starts rotating. When the rear end g2 of the document G is detected by the document sensor S5, however, the feed roller 5, reversible roller 10 and discharge roller 6 temporarily cease to rotate due to a signal from the document sensor S5, and the first conveying direction switching means 8 and the second conveying direction switching means 9 are switched to the positions of two-dot chain lines, respectively.

Then, the feed roller 5 and the discharge roller 6 are driven and, at the same time, the reversible roller 10 starts rotating in the forward direction to convey the document toward the space 24. Therefore, the document G with its back surface being faced downwards is conveyed to the document reader unit X where the back surface is read out, and the rear end g2 of the document G is taken by the switch-back path d. While the rear end g2 of the document G is being taken in, the follower roller 20 is separated away from the reversible roller 10 as shown in FIG. 3. Therefore, despite the side of the front end g1 of the document G is remaining in the switch-back path d, the rear end g2 of the document G is taken in by the switch-back path d without hindrance.

When the back surface of the document is read out and the front end g1 of the document G is detected by the document sensor S3, the reversible roller 10 starts reversely rotating, the second conveying direction switching means 9 is changed over to the position indicated by the two-dot chain line, and the front end g1 of the document G is guided by the first conveyer passage a1 of the outer peripheral surface 5*a* of the feed roller 5 which is at rest, so that the document is conveyed toward the discharge path c by the second conveying direction switching means 9 and is discharged onto the discharged paper stacker 7 accompanying the rotation of the discharge rollers 6. The discharge rollers 6 cease to rotate after the elapse of a predetermined period of time from when the rear end g2 of the document G is detected by the document sensor S4.

What we claimed are:

1. A document feeder for an image-forming apparatus comprising:

a feed paper stacker on which double-sided documents will be stacked;

a discharged paper stacker on which said documents after having been read out will be stacked;

a circulating path for guiding the documents through a document-reading position;

a feed path for feeding the documents from said feed paper stacker to said circulating path;

a discharge path for discharging the documents after having been read out onto the discharged paper stacker;

a switch-back path for switching back the document, disposed under said feed path or said feed paper stacker;

a first conveying direction switching means provided at a portion where said circulating path and said switch-back path are connected together to change over the direction of conveyance of the document to either said circulating path or said switch-back path; and a second conveying direction switching means provided at a portion where said circulating path and said discharge path are connected together to change over the direction of conveyance of the document to either said circulating path or said discharge path.

2. A document feeder for an image-forming apparatus according to claim 1, wherein in a case one surface only of the document is to be read out, said first conveying direction switching means guides the document to said circulating path, and in a case both surfaces of the document are to be read out, said first conveying direction switching means guides the document to said switch-back path.

3. A document feeder for an image-forming apparatus according to claim 1, wherein in a case one surface only of the document is to be read out, said second conveying direction switching means guides the document to said discharge path, and in a case both surfaces of the document are to be read out, said second conveying direction switching means guides the document of which the one surface has been read out to said circulating path, and guides the document which both surfaces have been read out to said discharge path.

4. A document feeder for an image-forming apparatus according to claim 1, wherein said circulating path is constituted by a first conveyer passage of from where it is connected to said feed path to where it is connected to said discharge path, and a second conveyer passage of from where it is connected to said discharge path to where it is connected to said feed path.

5. A document feeder for an image-forming apparatus according to claim 1, wherein said feed paper stacker, discharged paper stacker and switch-back path are arranged on the same side with respect to said reading position.

6. A document feeder for an image-forming apparatus according to claim 5, wherein said feed paper stacker, discharged paper stacker and switch-back path are arranged in the order of said feed paper stacker, discharged paper stacker and switch-back path from the upper side.

7. A document feeder for an image-forming apparatus according to claim 6, wherein said switch-back path is provided in space under said discharged paper stacker.

8. A document feeder for an image-forming apparatus according to claim 1, wherein said switch-back path is provided with a reversible roller which can rotate forward and reverse, and the document is switched back by switching the rotational direction of said reversible roller.

9. A document feeder for an image-forming apparatus according to claim 8, wherein said reversible roller forms a pair of rollers together with a follower roller, said rollers can be separated from each other and are separated from each other when the document spans across said circulating path and said switch-back path.

10. A document feeder for an image-forming apparatus according to claim 1, wherein discharge roller that rotates in one direction only is arranged in said discharge path.

11. A document feeder for an image-forming apparatus according to claim 1, wherein said circulating path is formed along the outer peripheral surface of a feed roller.

12. A document feeder for an image-forming apparatus according to claim 1, wherein said switch-back path is disposed between said document-reading position and said discharged paper stacker to switch back the documents.

13. An image-forming apparatus comprising:

a document reader means for reading images of documents;

a feed paper stacker on which double-sided documents will be stacked;

a discharged paper stacker on which said documents after having been read out will be stacked;

a circulating path for guiding the documents through said document reader means;

a feed path for feeding the documents from said feed paper stacker to said circulating path;

a discharge path for discharging the documents after having been read out onto the discharged paper stacker;

a switch-back path for switching back the document, disposed under said feed path or said feed paper stacker;

a first conveying direction switching means provided at a portion where said circulating path and said switch-back path are connected together to change over the direction of conveyance of the document to either said circulating path or said switch-back path; and a second conveying direction switching means provided at a portion where said circulating path and said discharge path are connected together to change over the direction of conveyance of the document to either said circulating path or said discharge path.

14. An image-forming apparatus according to claim 13, wherein in a case one surface only of the document is to be read out, said first conveying direction switching means guides the document to said circulating path, and in a case both surfaces of the document are to be read out, said first conveying direction switching means guides the document to said switch-back path.

15. An image-forming apparatus according to claim 13, wherein in a case one surface only of the document is to be read out, said second conveying direction switching means guides the document to said discharge path, and in case both surfaces of the document are to be read out, said second conveying direction switching means guides the document of which the one surface has been read out to said circulating path, and guides the document which both surfaces have been read out to said discharge path.

16. An image-forming apparatus according to claim 13, wherein said switch-back path is provided in space under said discharged paper stacker.

17. An image-forming apparatus according to claim 16, further comprising a platen for placing document thereon, and a support plate for pushing and supporting the document on said platen, wherein said support plate is disposed under the discharged paper stacker, and the document that has entered into said switch-back path is guided through space between the bottom surface of said discharged paper stacker and said support plate.

18. An image-forming apparatus according to claim 13, wherein said switch-back path is provided with a reversible roller which can rotate forward and reverse, and the document is switched back by switching the rotational direction of said reversible roller.

19. An image-forming apparatus according to claim 18, wherein said reversible roller forms a pair of rollers together with a follower roller, said rollers can be separated from each other and are separated from each other when the document spans across said circulating path and said switch-back path.

20. An image-forming apparatus according to claim 13, wherein discharge roller that rotates in one direction only is arranged in said discharge path.

21. An image-forming apparatus according to claim 13, wherein said circulating path is formed along the outer peripheral surface of a feed roller.

22. An image-forming apparatus according to claim 13, wherein said switch-back path is disposed between said document reader means and said discharged paper stacker to switch back the documents.

* * * * *